United States Patent [19]

Squitieri

[11] Patent Number: 4,590,696

[45] Date of Patent: May 27, 1986

[54] DISPLAY FRAME ASSEMBLY

[76] Inventor: Frank Squitieri, 495-4th St., Brooklyn, N.Y. 11215

[21] Appl. No.: 683,232

[22] Filed: Dec. 18, 1984

[51] Int. Cl.[4] ..... A47G 1/06; G09F 1/12

[52] U.S. Cl. ..... 40/156; 40/152; 40/152.1

[58] Field of Search ..... 40/152, 152.1, 156, 40/160, 159, 155, 158, 1

[56] References Cited

U.S. PATENT DOCUMENTS

| | | | |
|---|---|---|---|
| 683,711 | 10/1901 | Silverberg | 40/156 |
| 796,838 | 8/1905 | Fraser | 40/156 |
| 1,857,966 | 5/1932 | Long | 40/156 |
| 2,173,753 | 9/1939 | Copeland | 40/156 |
| 3,070,914 | 1/1963 | Henderson et al. | 40/156 |
| 3,255,544 | 6/1966 | Bornholt | 40/156 |
| 3,670,439 | 6/1972 | Shimizu | 40/156 |
| 3,996,682 | 12/1976 | Schwartz | 40/156 |
| 4,037,342 | 7/1977 | Bott | 40/156 |
| 4,041,632 | 8/1977 | Sarkisian | 40/156 |
| 4,216,597 | 8/1980 | Kocina et al. | 40/156 |

*Primary Examiner*—John J. Wilson
*Assistant Examiner*—James Hakomaki
*Attorney, Agent, or Firm*—Nathaniel Altman

[57] ABSTRACT

A display frame assembly for mounting, framing and hanging objects of visual interest such as paintings, prints and especially phonograph record album covers, includes a frame element, the outer surrounding walls of which not only define the centrally disposed display opening but also carry frame-reinforcing ribs projecting rearwardly and substantially perpendicularly from their rear surfaces. The reinforcing ribs are positioned and extend to form, together with the rear surface lip of the frame between the display opening and the ribs, a nest into which the object to be framed may be fittingly inserted. A plurality of spring retaining clips are provided which are to be mounted adjustably and tensionedly on the reinforcing ribs of the frame; a portion of each clip, when mounted, extends inwardly across a portion of the framed object, which is thus held firmly against the rear surface lip of the frame. A mounting bracket is also provided, the mounting bracket and the frame element having mating complementary coupling means so that, when pressed together and the mounting bracket hung on a nail or picture hook on the wall, the frame member is supported firmly yet removably.

18 Claims, 23 Drawing Figures

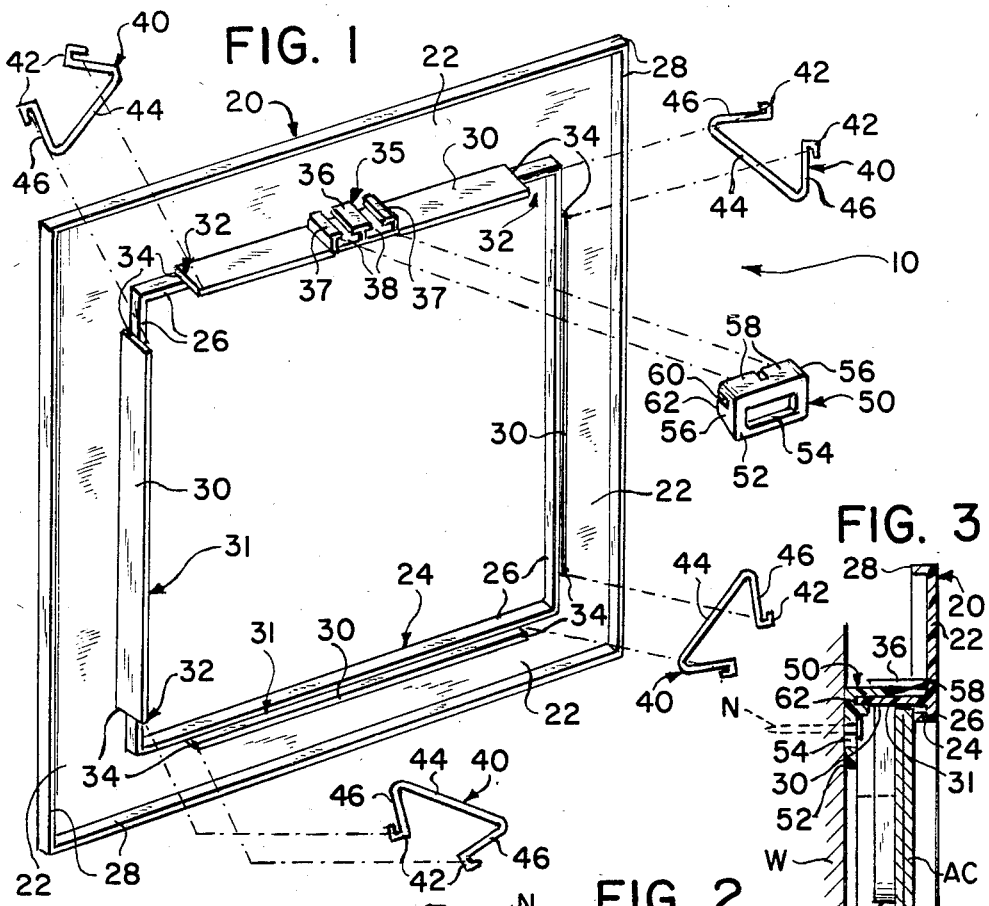
FIG. 1
FIG. 2
FIG. 3
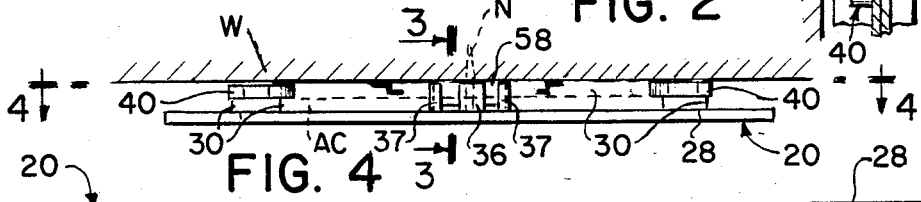
FIG. 4
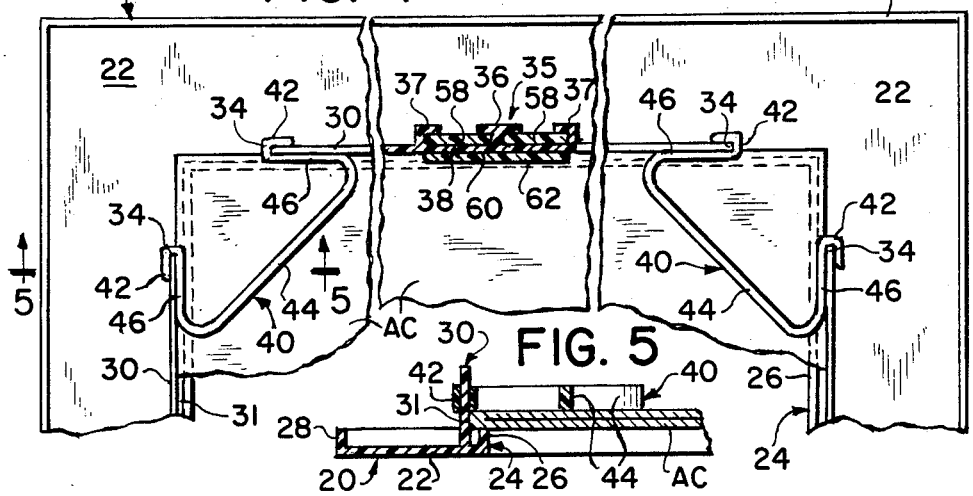
FIG. 5

94°

DISPLAY FRAME ASSEMBLY

BACKGROUND OF THE INVENTION

Conventional display frames represent a daunting, finger-threatening experience for the average person to face in attempting to frame and hang a painting, print, photograph or the like. Mounting the object to be framed, in the case of wood frames, involves the hammering of small tacks or wafer-thin wedges laterally, putting those fingers attempting to hold them at grave risk. For metal frames, brackets must be laboriously screwed or bolted into place. When preparing the conventional wood or metal frame for hanging, one is required to handle prickly picture wire, either twisting or knotting it to form and secure the loop for hanging to the frame. Additionally, the frame hung by its traditional wire loop on picture hook or nail affords an even more severe challenge to one who wishes to adjust the frames height by changing the length of the loop.

The present invention has as a prime object the elimination of the aobve hazards and difficulties by the provision of a novel display frame assembly for the simple, rapid toolless mounting, securing and hanging of an object to be framed. It is also an object of this invention to produce a frame assembly attractive and decorative to the eye, sturdy in construction and inexpensive to manufacture. A particular purpose of this invention is to supply frame assemblies for mounting and hanging phonograph record album covers, with a variety of frame designs and surface decorations available.

Applicant is unaware of any prior art in any way relevant to the concepts of this invention as hereinafter described and claimed.

SUMMARY OF THE INVENTION

The novel display frame assembly features a frame member, the walls of which surround and define the frame's display opening, with reinforcing ribs projecting rearwardly from the frame walls' rear surface and extending along a path intermediate between the walls' inner and outer edges. In the preferred embodiments of this invention, the reinforcing ribs of the frame are interrupted by a plurality of gaps at spaced intervals, each gap being dimensioned to permit the attachment of a resilient retaining clip on the gap's edges. The frame's reinforcing ribs outline a nest into which the object to be framed is fittingly inserted for mounting: after the insertion, the retaining clips are adjustably positioned on and frictionally held to the rib gaps' edges, each retaining clip having a portion overlying and firmly holding the object being framed against the rear surface of the frames' walls. A frame mounting bracket, with coupling means complementary to corresponding coupling means on the frame, is affixed removably to the frame with its mounted object by pressing the mating complementary coupling means into frictional engagement and then hung on a conventional nail or picture hook previously secured and appropriately placed on a wall.

The frame assembly of this invention may be provided in a wide assortment of sizes, shapes and styles to accomodate all sorts of framable objects of visual interest such as phonograph record album covers, paintings, prints, textiles and the like, with accompanying front glass, matting and backing if desired.

Full details of the concepts embodied in, and the best modes now contemplated for, practising the present invention will now be described clearly and concisely, in connection with the accompanying illustrative drawings, wherein:

SHORT FIGURE DESCRIPTION OF DRAWINGS

FIG. 1 is an exploded rear perspective view of a preferred embodiment of the display frame assembly of this invention;

FIG. 2 is a top plan view of the frame assembly of FIG. 1 assembled and mounted on a wall;

FIG. 3 is a sectional partial view taken along line 3—3 of FIG. 2;

FIG. 4 is a fragmentary sectional view taken along line 4—4 of FIG. 2;

FIG. 5 is a sectional view taken along lines 5—5 of FIG. 4;

Figures 6, 7, 8, 9, 10, 11, 12, 13, 14, 15, 16, 17, 18, 19, 20, 21, 22, 23:
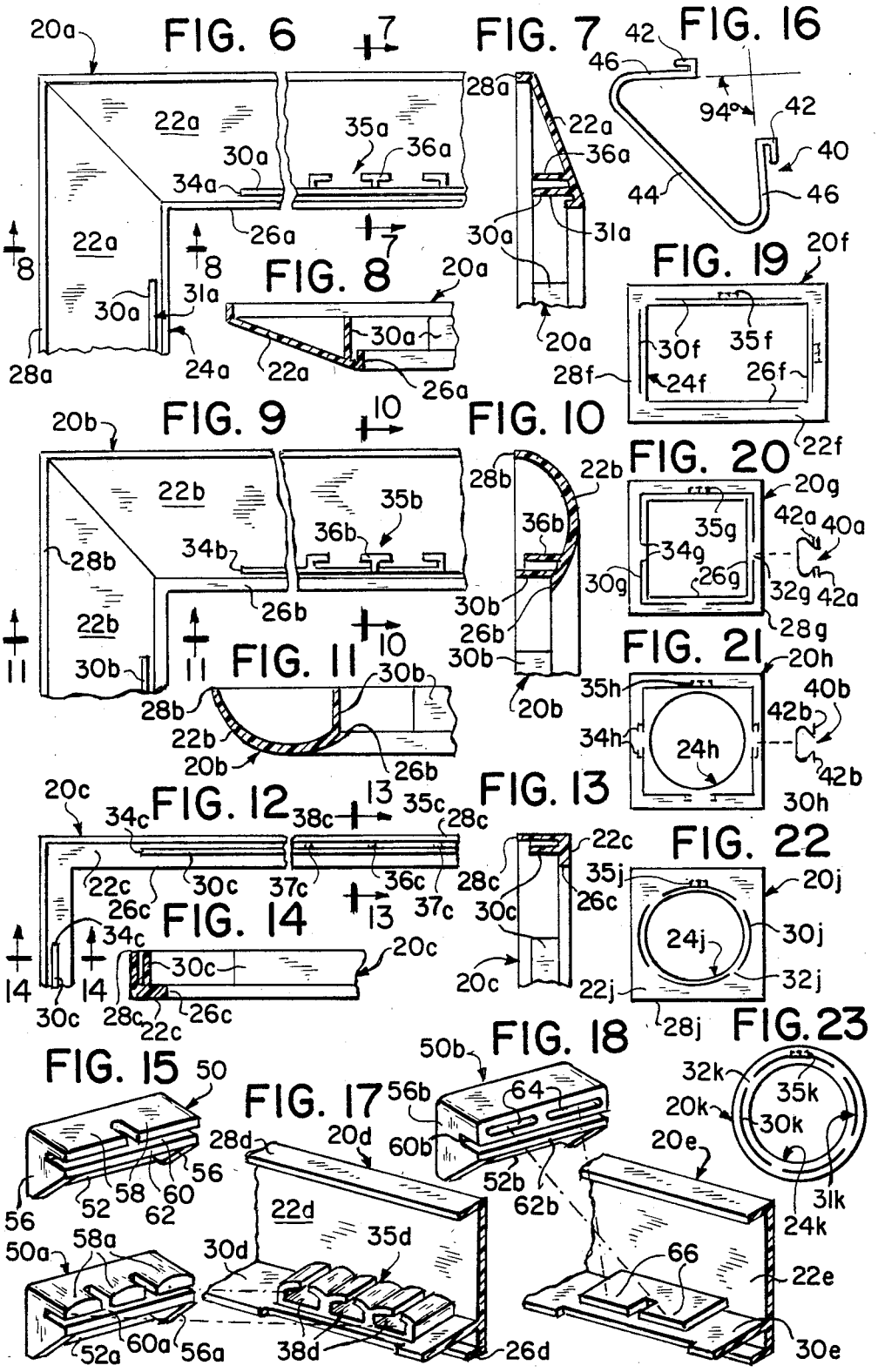
FIG. 6 is a fragmentary rear view of another embodiment of a frame element.

FIGS. 7 and 8 are sectional views taken along lines 7—7 and 8—8 of FIG. 6 respectively;

FIG. 9 is a fragmentary rear view of still another embodiment of a frame element;

FIGS. 10 and 11 are sectional views taken along lines 10—10 and 11—11 of FIG. 9 respectively;

FIG 12 is a fragmentary rear view of yet another embodiment of a frame element;

FIGS. 13 and 14 are sectional views taken along lines 13—13 and 14—14 of FIG. 12 respectively;

FIG. 15 is a front perspective view of the mounting bracket of FIG. 1;

FIG. 16 is a front elevational view of one of the resilient retaining clips of FIG. 1;

FIG. 17 is an exploded perspective view of a modified frame and mounting bracket;

FIG. 18 is an exploded perspective view of another modified frame and mounting bracket; and FIGS. 19–23 are schematic rear elevational views of various modifications of frame elements and retaining clips.

DESCRIPTION OF THE PREFERRED EMBODIMENTS

FIGS. 1–5 illustrate a preferred embodiment of the display frame assembly, generally designated 10, comprising shadow-box frame 20, resilient retaining clips 40, and mounting bracket 50. Frame 20 is formed of walls 22, surrounding and defining display opening 24, walls 22 extending from inner rearwardly turned edges 26 to outer rearwardly turned edges 28. As shown in FIG. 1, reinforcing ribs 30 project rearwardly from the rear surfaces of walls 22 and follow a path intermediate between inner edges 26 and outer edges 28, forming nest 31. Gaps 32 interrupt ribs 30 at the corners to provide gap edges 34. One wall 22 of frame 20 also carries frame coupling means 35, which includes center T-shaped portion 36, inverted-L-shaped portions 37; together with reinforcing ribs 30, portions 36 and 37 form coupling sockets 38.

Frame 20 may be produced advantageously by one-piece molding. While many plastic materials may be used for this purpose, consideration of strength, flexibility and cost make the preferred choice medium impact styrene; for superior decorative character, however, another form of styrene known commercially as ABS may be substituded advantageously.

Each resilient retaining clip 40 terminates at both ends in U-shaped channels 42, which are connected to center retaining crossbar 44 by clip side portions 46. As best seen in FIG. 16, each clip 40 is formed with side portions 46 at an angle of 94° with each other, so that sides 46 must be pressed toward each other into a right angle relationship. Clips 40 are also preferably molded from medium impact styrene.

Mounting bracket 50 has back wall 52 with slot 54 therein, side walls 56, upper projections 58, horizontal longitudinal slot 60 and lower edge 62, as may be seen in both FIGS. 1 and 15. Bracket 50 also is molded preferably from medium impact styrene.

FIGS. 2–5 show frame assembly 10 in use, hung on room wall W and holding phonograph record album cover AC. To achieve this, frame member 20 is first placed rear side up and album cover AC is inserted into nest 31, which is dimensioned to accept AC fittingly. Now retaining clips 40 are sequentially compressed, permitting U-shaped channel ends 42 to be mounted slidably on end walls 34 of each gap 32; each resilient clip 40, after being pressed downwardly into firm contact with album cover AC, is released to spring outwardly so that both U-shaped channels 42 and side portions 46 are biased into frictional engagement with reinforcing ribs 30. Next, frame 20 and bracket 50 are pressed together into the frictional engagement of coupling means 35 with the coupling means of bracket 50, so that projections 58 enter sockets 38 and reinforcing rib 30 enters horizontal slot 60 to rest on lower ledge 62. Finally the combined frame asssembly 10 is hung on wall W in a conventional manner, on nail N or a picture hook through slot 54 on back 52 of bracket 50. Thus framed album cover AC is hung securely on wallW.

It should be evident that the assembly procedure outlined above can be readily reversed by lifting frame assembly 10 down off nail N and wall W, slightly compressing and removing retaining clips 40, and removing album cover AC from nest 31 of frame 20; now, if desired, a second album cover or other object of visual interest may be mounted, framed and hung in frame assembly 10 as described above. Such other objects of visual interest-paintings, prints, photographs and the like may be mounted in frame assembly 10 in combination with any or all of the following: front glass, matting and backing.

FIGS. 6–8 illustrate a beveled framed 20*a*, similar in every respect to frame 20, except that frame walls 22*a* are angled as shown. In like manner, FIGS. 9–11 show an arced frame 20*b* with curved walls 22*b*, with all other features and functions identical with those of frames 20 and 20*a*.

Museum frame 20*c*, illustrated in FIGS. 12–14, corresponds to the frames previously described but has a modified coupling means 35*c*. Here sockets 38*c* are formed by center dividing wall 36*c* and outer dividing walls 37*c* extending between outer frame edge 28*c* and reinforcing rib 30*c*.

All of the frames described in this application may be decorated on their front surfaces, if desired, by coloring, texturing, grooving, beading, or embossing designs or indicia thereon.

FIG. 17 shows a modified form of coupling means between shadowbox frame 20*d* and mounting bracket 50*a*, with rounded projections 58*a* on bracket 50*a*, and corresponding mating sockets 38*d* on frame 20*d*. In FIG. 18, bracket 50*b* carries coupling sockets 64 while frame 20*e* is molded with the corresponding mating projection 66.

It may be noted that mounting bracket 50 may be coupled invertedly with frames 20, 20*a*–20*c* still perform adequately.

The schematic drawings of FIGS. 19–23 illustrate a variety of frames and retaining clips. Frame 20*f* of FIG. 19 is rectangular in shape and carries two coupling means 35*f*, so that it may be hung in either direction. Frame 20 of FIG. 20 has gaps 32*g* situated along the course of reinforcing ribs 30*g* instead of at the corners; retaining clip 40*a* has U-shaped channel ends 42*a* in linear alignment to be mounted on gap walls 34*g*.

Frame 20*h* of FIG. 21 has a round display opening 24*h* and gap and walls 34*h* provided with U-shaped channels 68 for receiving the plain ends 42*b* of each retaining clip 40*b*. In FIG. 22 frame 20*j* has elliptical display opening 24*j* with reinforcing ribs 30*j* following the same curvature; in FIG. 23, frame 20*k* is round in shape with corresponding round display opening 24*k* and concentric reinforcing ribs 30*k* for accepting a round object to be framed in nest 31*k*.

In addition to the embodiments and modifications herein illustrated and described, variations and other combinations of the concepts of this invention have been contemplated and are restricted and defined only by the scope of the ensuing claims. For example, one variation is to mount bracket 50 on frame 20 as a first step, even at the factory, then follow the assembly procedure of inserting AC, and so on. Another alternative is to secure bracket 50 on wall W first, then assemble frame 20, album cover AC and clips 40, finally pressing frame and bracket together. Still another variation (not shown) would provide an open chamber in place of coupling means 35 on frame 20; a groove in the top wall of this chamber to be rested on nail N and thus hang the frame without a bracket.

What is claimed is:

1. Frame assembly for mounting, framing and displaying a framable object of visual interest, which comprises:

frame means comprising continuous walls and a centrally disposed display opening surrounded by and defined by said continuous walls; and frame-reinforcing rib means projecting rearwardly from, and substantially perpendicular to, the rear surface of said continuous walls of said frame means, said rib means being positioned and generally extending along a path intermediate between the inner and outer edges of said continuous walls of said frame means, so that a nest, formed by and comprising the inner walls of said frame-reinforcing rib means and the rear surface portion of said continuous walls of said frame means extending between said rib means and said centrally disposed display opening, is provided, said nest fittingly accommodating the framable object.

2. Frame assembly in accordance with claim 1, wherein said frame means and rib means are formed as a molded plastic integral unit.

3. Frame assembly in accordance with claim 2, wherein said molded plastic integral unit is formed from medium impact styrene.

4. Frame assembly in accordance with claim 1, further comprising:

a plurality of resilient retaining clip means to be fastened individually adjustably, tensionedly and removably on said reinforcing rib means of said frame means, said retaining clip means each having a portion extending from its attachment inwardly to overlay and hold a portion of the framed object firmly against said rear surface lip of said walls.

5. Frame assembly in accordance with claim 4, wherein said resilient retaining clip means are formed with U-shaped channels at each end, and said reinforcing rib means of said frame means are formed with a plurality of gaps at spaced intervals, said gaps being dimensioned so that the terminal ends of said frame rib means created by said gaps may accommodate removably said U-shaped channels of said retaining clips in slidable, adjustable tensioned engagement.

6. Frame assembly in accordance with claim 4, wherein said resilient retaining clip means are each molded from medium impact styrene.

7. Frame assembly in accordance with claim 5, wherein said frame means is rectangular in shape and said gaps in said rib reinforcing means are positioned in the four corners where said rib means would otherwise meet at right angles.

8. Frame assembly in accordance with claim 1, wherein said nest, formed by said inner walls of said rib means and said rear surface of said frame walls, is of substantially square shape and dimensioned for a phonograph record album cover to be fittingly inserted therein.

9. Frame assembly in accordance with claim 4, wherein said frame-reinforcing ribs project rearwardly from said rear surface of said frame walls for a distance of not less than 0.5 inch to provide sufficient depth to said nest for accommodating the thickness of both the object to be framed and said retaining clip means.

10. Frame assembly in accordance with claim 1, further comprising:

mounting bracket means to be secured to the wall on which the framed object is to be hung, said frame means and said mounting bracket means having mutually mating complementary coupling means so that, when pressed together to engage said coupling means, said mounting bracket means holds said frame means removably in secure supportive frictional relationship on the wall.

11. Frame assembly in accordance with claim 10, wherein said mounting bracket means has a lower ledge positioned so that, when said mounting bracket means is secured to the wall and has said frame means frictionally secured by said complementary mating coupling means, a portion of said reinforcing rib means of said frame means overlies and is supportively held by said lower ledge.

12. Frame assembly in accordance with claim 10, wherein said frame means carries said complementary mating coupling means in the form of at least one receiving socket while said mounting bracket means carries said complementary mating coupling means in the form of at least one projection.

13. Frame assembly in accordance with claim 4, wherein said reinforcing rib means of said frame means are formed with a plurality of gaps at spaced intervals, the terminal ends of said frame rib means created by said gap, being shaped into U-shaped channels to accommodate the insertion of the ends of said resilient retaining clip means into slidable adjustable tensioned engagement.

14. Frame assembly for mounting, framing and hanging on a wall a framable object of visual interest, which comprises:

frame means comprising continuous walls and a centrally disposed display opening surrounded by and defined by said continuous walls;

frame-reinforcing rib means projecting rearwardly from, and substantially perpendicular to, the rear surface of said continuous walls of said frame means, said rib means being positioned and generally extending along a path intermediate between the inner and outer edges of said continuous walls of said frame means, so that a nest, formed by and comprising the inner walls of said frame-reinforcing rib means and the rear surface portion of said continuous walls of said frame means extending between said rib means and said centrally disposed display opening, is provided, said nest fittingly accommodating the framable object;

a plurality of resilient retaining clip means to be attached individually, adjustably, tensionedly and removably on said frame-reinforcing rib means, each of said retaining clip means having a portion extending from the attachment portion of said retaining clip means inwardly to overlay and hold a portion of the framable object firmly against said rear surface portion of said continuous walls of said frame means; and mounting bracket means to be secured to the wall on which the framable object is to be hung, said frame means and said mounting bracket means having mutually mating complementary coupling means so that, when pressed together to engage said mutually mating coupling means, said mounting bracket means holds said frame means removably in secure supportive relationship on the wall.

15. A method of mounting, framing and hanging on a wall an object of visual interest capable of being framed, using a frame assembly which comprises; a frame member comprising continuous walls and a centrally disposed display opening surrounded by and defined by said continuous walls; frame-reinforcing rib means projecting rearwardly from, and substantially perpendicular to, the rear surface of said continuous walls of said frame member, said rib means extending along a course intermediate between the inner and outer edges of said continuous walls and forming a nest within said rib means and backed by the rear surface portion of said continuous walls extending between said rib means and said centrally disposed display opening; a plurality of resilient retaining clip means to be attached individually, adjustably, tensionedly and removably on said reinforcing rib means of said frame member, each of said retaining clip means having a portion which extends inwardly from the attachment portion of said clip means to overlay and hold a portion of the object capable of being framed firmly against said rear surface portion of said continuous walls; and mounting bracket means having coupling means for engagement with complementary mating coupling means on said frame member, said method comprising the steps of:

(a) inserting the object capable of being framed into said nest;

(b) attaching each of said retaining clip means to said reinforcing rib means so that said inwardly extending portion of each of said clip means overlies and bears against the rear surface of the object capable of being framed;

(c) pressing said frame member against said mounting bracket means so that both said complementary coupling means are cooperatively and frictionally engaged; and (d) securing said mounting bracket to a wall by conventional means.

16. The method according to claim 15, which comprises, when replacement of the framed object is desired, the further steps of:

(e) removing said mounting bracket coupled to said frame member from the wall;

(f) detaching said retaining clip means from said reinforcing rib means;

(g) removing the framed object from said nest; and (h) repeating steps (a), (b) and (d) with the new object to be framed.

17. The method in accordance with claim 15, wherein the order of said steps is: (c), (a), (b) and (d).

18. The method in accordance with claim 15, wherein the order of said steps is: (d), (a), (b) and (c).

* * * * *